United States Patent [19]

Taylor et al.

[11] Patent Number: 5,045,411

[45] Date of Patent: Sep. 3, 1991

[54] ALLOY COMPOSITIONS

[75] Inventors: Arthur D. Taylor, Buffalo; Malcolm Warren, Corfu, Perry H. Berger, West Amherst, both of N.Y.

[73] Assignee: P.M. Refining, Inc., Alden, N.Y.

[21] Appl. No.: 463,153

[22] Filed: Jan. 10, 1990

[51] Int. Cl.[5] ..... C22C 5/02; C22C 5/08; C22C 9/00

[52] U.S. Cl. ..... 428/672; 420/481; 420/483; 420/503; 420/504; 420/511; 420/582; 420/587

[58] Field of Search ..... 420/481, 483, 503, 504, 420/511, 512, 582, 587; 428/672

[56] References Cited

U.S. PATENT DOCUMENTS

| | | | |
|---|---|---|---|
| 1,580,444 | 4/1926 | Shields | 420/511 |
| 2,141,157 | 12/1936 | Peterson | 420/511 |
| 2,229,463 | 1/1941 | Leach | 420/511 |
| 2,248,100 | 7/1941 | Loebich | 420/511 |
| 2,270,594 | 1/1942 | Leuser | 420/587 |
| 2,654,146 | 10/1953 | Mooradian | 420/483 |

FOREIGN PATENT DOCUMENTS

| | | | |
|---|---|---|---|
| 69338 | 6/1981 | Japan | 420/587 |
| 1-57237 | 9/1989 | Japan | 420/511 |

*Primary Examiner*—Richard O. Dean
*Assistant Examiner*—George Wyszomierski
*Attorney, Agent, or Firm*—Saperston & Day

[57] ABSTRACT

A gold based alloy containing gold, silver, copper, zinc, silicon, iron, boron, nickel and indium for the manufacture of gold articles is described which has a lower melting point, extended remelting capabilities, high resistance to cracking, improved color consistency and increased ductility.

7 Claims, No Drawings

ALLOY COMPOSITIONS

BACKGROUND OF THE INVENTION

1. Field of the Invention

This invention relates to alloys, and more particularly, to a novel gold-based alloy containing gold, silver, copper, zinc, silicon, iron, boron and indium which has high resistance to cracking, improved color consistency and increased ductility for use in the manufacture of jewelry.

2. Statement of the Known Prior Art

Gold based alloys containing gold, silver, copper, iron and zinc are known to be suitable for use in the manufacture of jewelry. The proportions of constituents, such as silver, copper, iron and zinc, will vary in accordance with the purposes for which the alloy is to be used, to optimize certain metallurgical properties, and/or to obtain a desired color. U.S. Pat, No. 2,141,157 issued to Peterson is directed towards alloy compositions for the manufacture of gold articles consisting of about 33% to 84% gold, 10.7% to 67% copper, 0.1% to 5% cobalt, 2% to 10% silver and 2% to 10% zinc.

U.S. Pat. No. 2,248,100 issued to Loebich is directed towards alloys containing 33% to 60% gold, 10% to 55% copper, 0.5% to 25% zinc, 1% to 30% silver and 0.1% to 5% iron.

U.S. Pat. No. 2,229,463 issued to Leach discusses gold alloys consisting of 35% to 75% gold, 5% to 25% silver, 12% to 35% copper, 0.1% to 12% zinc and 1% to 5% iron.

However, each of these known alloys have not solved the typical problems associated with gold based alloys. Gold-base alloys, heretofore commonly used for making jewelry articles from sheet and wire, frequently develop the defect known as "orange peel" when the alloy is alternately subjected to stress at a high temperature and mechanical working at room temperature. This defect is due to a coarse grain structure and is characterized by surface roughness similar in appearance to the outer surface of the skin of an orange. This appearance is objectionable because a smooth even lustrous surface, normally required in finished gold jewelry, becomes difficult or impossible to obtain. It is particularly objectionable when it develops on the gold alloy clad layer of rolled gold plate. Mechanical shaping often produces this deformation which often results in exposing the base metal substrate.

Other difficulties encountered with known gold based alloys are the variations in color and surface texture form the construction of jewelry using investment cast and stamped components. Since components stamped from rolled sheet stock generally are of a different color than investment cast parts due to the compositional differences necessary to obtain certain physical properties required for mechanical stamping which may be unsuitable for investment casting techniques. Therefore, multicomponent jewelry usually requires electroplating following basic construction in order to obtain a single uniform color and texture throughout.

Another of the difficulties encountered in the manufacture of clad gold articles of jewelry is the provision of a gold plate which will stand up against the abrasion caused by clothing, etc. The gold plate of such an article is generally very thin, and the life of a clad gold article is determined to a great extent by the resistance to abrasion of the gold plate. It is known to provide gold alloys of a given karat with metals of harder nature to withstand wear. The effect on the gold alloy is to give greater hardness, but the resulting color and required ductility, from the standpoint of the jewelry industry, is not as good as softer alloys. Consequently, it has been a problem to provide a hard gold alloy in a given karat which produces a color and grain structure acceptable to the jewelry industry.

In order to obtain high quality investment castings certain elements (e.g. silicon) must be added to provide smooth shinny surfaces and limited remelting capabilities. Silicon bearing alloys normally are unsuitable for sheet rolling and wire drawing. Sheet and wire alloy preparations often use phosphorus as a deoxidant which causes a dull, discolored surface on investment cast jewelry.

In the manufacture of many articles of jewelry, either the goldclad variety or the solid karat gold variety, it is necessary many times in the course of manufacture, to submit the article to either high annealing temperatures or high soldering temperatures. Known gold alloys of similar color have softened unduly with either of these treatments, causing distortion and too great flexibility in the finished article. This condition may create excessive wear after use. This is caused by softness in the finished article caused by many necessary annealing operations during the manufacturing process.

SUMMARY OF THE INVENTION

An object of the present invention is a gold based alloy which can be used to manufacture solid gold investment cast jewelry, gold-clad jewelry, or jewelry fabricated from wire and sheet without sacrificing color, hardness, appearance and quality.

Another object of the present invention is a novel gold based alloy of this invention which provides greater hardness, resistance to wear, more consistent uniform color than standard compositions used for similar purposes.

Another object of the present invention is to provide a novel gold based alloy in which the physical properties can be controlled to correspond to the nature of the articles into which it is to be manufactured by varying the amounts of the constituents.

It is another object of the present invention to provide a gold based alloy which is adaptable for a given hardness to many fabrication techniques due to increased ductility.

Yet another object of the present invention is to provide an alloy which, for a given karat and given color, has much greater wear resistance than other known gold alloys of similar karat and color.

A further object of the present invention is to provide an alloy which has a very fine, close grain in both sheet and wire fabrication as well as investment cast materials.

The novel gold based alloy of the present invention comprises gold, silver, copper, zinc, silicon, iron, nickel, boron, indium, and phosphorus in varying amounts to enable the alloy to be used in either investment castings or rolling and cladding processes.

DESCRIPTION OF THE PREFERRED EMBODIMENTS

The gold based alloy of the present invention consists of gold, silver, copper, zinc, nickel, silicon, iron, boron, indium and phosphorus.

The new alloys may be made with varying amount of gold, depending on the karat desired. In general, the alloy contains substantial amounts of gold, silver, copper and zinc and lesser amounts of iron, silicon, nickel, boron, indium and phosphorus. The proportions of these constituents will vary in accordance with the purposes for which the alloy is to be used, but ordinarily the proportions will fall within the ranges given in the following analysis:

| Constituent | General Range of Percentages | Preferred Range of Percentages |
|---|---|---|
| Gold | 25.00%-92.00% | 41.67%-75.00% |
| Silver | 1.00%-50.00% | 4.75%-6.66% |
| Copper | 1.00%-50.00% | 30.88%-43.61% |
| Zinc | 0.10%-20.00% | 1.00%-7.00% |
| Nickel | 0.00%-5.00% | 0.05%-0.20% |
| Iron | 0.01%-2.00% | 0.05%-0.45% |
| Indium | 0.00%-2.00% | 0.30%-0.60% |
| Silicon | 0.01%-1.00% | 0.02%-0.60% |
| Boron | 0.00%-1.00% | 0.001%-0.15% |
| Phosphorus | 0.00%-0.05% | 0.00%-0.20% |

The gold content depends upon the desired karat of the gold. The present invention relates principally to alloys within the karat range of 6 to 22; hence the proportion of gold in the alloy, by weight, may vary from about 25% to about 92%.

The silver content may vary from about 1% to about 50% by weight of the alloy. Silver helps achieve the desired color in the alloy, as well as affecting the malleability.

The zinc content may vary from about 0.10% to about 20.0%, by weight, of the alloy. Zinc also helps achieve the desired color, hardens the alloy and acts as deoxidizer.

The copper content may vary from about 1% to about 50%, by weight, of the alloy, depending upon the desired color, hardness, and other qualities desired of the alloy.

The nickel content may vary from about 0.00% to 5.00% by weight of the alloy. Nickel seems to act as a decolorizing agent as well as a grain size regulator when added in amounts similar to that of iron. Nickel used without iron does not affect the alloy hardness in the general composition range and results in little to no change in grain size for a given gold, silver, zinc, copper jewelry composition.

Phosphorus may be substituted for silicon as a deoxidizer. In the prior art, phosphorus was used as a deoxidant for gold alloy compositions which were intended for rolling and wire drawing since silicon bearing alloys tended to crack after minimal cold working. In the present invention, the negative effects of silicon as a deoxidizer in rolling compositions are eliminated while preserving the desirable surface quality and color in investment cast jewelry.

The iron content may vary from about 0.01% to about 2.0%, by weight, of the alloy. Iron, possibly in combination with the nickel, seems to act as the regulator of the grain size in the alloy. If no iron is used, the grain size of the alloy of the present invention is not superior to the grain size of prior gold alloys.

The remaining metals make up the balance of the alloy. The silicon content may vary from about 0.10% to about 1.0%, by weight. The boron content may vary from 0.00% to about 1.0%, by weight of the alloy. Boron and indium are added to increase fluidity which results in improved investment castings.

The chart below sets out alloys embodying the principles of the present invention for 10 karat, 14 karat and 18 karat compositions.

With the exception of the alloys designated by the letter "A" the following table gives the compositions of several specific alloys that have been made in accordance with the teachings of the present invention. Alloys "$A_1$"-"$A_3$" are typical of karat gold compositions and are given primarily for comparative purposes. The characteristics of these compositions are well known throughout the industry. Alloys "$B_1$"-"$B_3$" are karat gold compositions made according to the principles of this invention. Alloys "$C_1$" and "$C_2$" are also karat gold compositions made according to the principles of this invention.

CONSTITUENT PERCENTAGES

| Comp. | Karat Comp. | Gold | Silver | Copper | Zinc | Nickel | Iron | Indium | Boron | Silicon | Phosp. |
|---|---|---|---|---|---|---|---|---|---|---|---|
| | 10K | 41.67 | Balance | Balance | Balance | 0.05-0.2 | 0.05-0.45 | 0.01-2 | 0.001-0.5 | 0.01-1.0 | 0-1.0 |
| | 14K | 58.33 | Balance | Balance | Balance | 0.05-0.2 | 0.05-0.45 | 0.01-2 | 0.001-0.5 | 0.01-1.0 | 0-1.0 |
| | 18K | 75.00 | Balance | Balance | Balance | 0.05-0.2 | 0.05-0.45 | 0.01-2 | 0.001-0.5 | 0.01-1.0 | 0-1.0 |
| $A_1$ | 10K | 41.67 | 6.358 | 42.986 | 8.692 | 0 | 0 | 0 | 0.002 | 0.208 | 0.00 |
| $A_2$ | 14K | 58.33 | 4.542 | 30.71 | 6.208 | 0 | 0 | 0 | 0.002 | 0.208 | 0.00 |
| $A_3$ | 18K | 75.00 | 12.50 | 11.510 | 0.813 | 0 | 0 | 0.125 | 0 | 0.052 | 0.00 |
| $B_1$ | 10K | 41.67 | 10.905 | 40.645 | 6.242 | 0.070 | 0.116 | 0.175 | 0.002 | 0.175 | 0.00 |
| $B_2$ | 14K | 58.33 | 5.958 | 30.699 | 4.628 | 0.050 | 0.083 | 0.125 | 0.002 | 0.125 | 0.00 |
| $B_3$ | 18K | 75.00 | 13.90 | 9.981 | 1.00 | 0.030 | 0.05 | 0.00 | 0.001 | 0.038 | 0.00 |
| $C_1$ | Formula $A_1$ with 0.116% Nickel, 0.116 Iron, 0.175 Indium and Copper 42.579% | | | | | | | | | | |
| $C_2$ | Formula $A_2$ with 0.083% Nickel, 0.083 Iron, 0.125 Indium and Copper 30.419% | | | | | | | | | | |

Heretofore separate alloy formulations were mandated for investment casting and cladding. The novel alloy of this invention can be used in either investment casting or cladding with quality and results equal to or better than existing formulations.

Currently available gold based alloys can be melted only one or two times without the addition of about 50% of new alloy before the quality of the products is markedly reduced due to oxidation of the copper and other base metals contained in the alloy composite. The novel alloy of this invention contains relatively high levels of silicon which enables remelting of the new alloy at least ten times before any detectable loss in quality is observed.

The addition of iron and nickel significantly increases the ductility in both investment cast and sheet wire products. Increased ductility is a highly desirable characteristic of a jewelry formulation since it allows easier rolling (i.e., machine fabrication) as well as less controllable hand fabrication (e.g., stone setting) without the usual rejections due to cracking from a large grain size.

The new alloy has a lower melting point as compared with alloy compositions at similar primary components, i.e., copper, zinc, silver and gold. This condition results in a decrease in the oxidation of copper during the molten stage and also preserves the silicon deoxidizer. Also, the amount of copper oxidized is reduced, resulting in better quality finished products. The longer the silicon is preserved the more times the scrap material can be used without loss of quality.

The following table compares the hardness measurements and grain size for each alloy composition noted.

INVESTMENT CAST PRODUCTS

| COMPOSITION | HARDNESS (1) | APPROX. GRAIN SIZE |
|---|---|---|
| COMPARISON OF GRAIN SIZE AND HARDNESS VALUES IN 10K CASTINGS | | |
| A1 | 32 | 2.79MM |
| B1 | 65 | 0.64MM |
| COMPARISON OF GRAIN SIZE AND HARDNESS VALUES IN 14K CASTINGS | | |
| A2 | 41 | 2.79MM |
| B2 | 44 | 0.55MM |
| COMPARISON OF GRAIN SIZE AND HARDNESS VALUES IN 18K CASTINGS | | |
| A3 | 35 | 0.93MM |
| B3 | 51 | 0.18MM |

The prior art teaches that the "A" compositions should be harder than the "B" compositions due to the higher levels of silicon, zinc and copper and resulting lower levels of silver. The increase in hardness seems to originate from the smaller, closer packed grain structure. Both the smaller grain size and hardness are desirable characteristics in a gold jewelry alloy for investment casting. All of the "A" compositions cracked under limited twisting and bending while the "B" formulations containing iron, indium and nickel showed no noticeable defects after similar cold working.

The "B" alloys would be expected to be softer and have similar grain sizes as the "A" alloy. However, the "B" alloys are harder and have a reduced grain size.

The "D" alloys show the effect upon grain size of the low level additions of nickel, iron and indium to known standard karat formulations, set out in the "A" alloys.

STATIC CAST PLATES

| Composition | 50%[2] Reduction | Ann. | 50% Reduction | Ann. | Approx.[3] Grain Size |
|---|---|---|---|---|---|
| COMPARISON OF HARDNESS VALUES[1] IN 10K PLATES | | | | | |
| A1 | 95 | 76 | 95 | 74 | 0.080MM |
| D1 | 98 | 79 | 99 | 78 | 0.008MM |
| COMPARISON OF HARDNESS VALUES[1] IN 14K PLATES | | | | | |
| A2 | 99 | 79 | 99 | 76 | 0.038MM |
| D2 | 98 | 80 | 99 | 78 | 0.004MM |

[1]Rockwell - B with 100 Kg load
[2]Plate cast thickness 0.135 inches
[3]Grain size measured at 0.015 inches after annealing The above data table seems to indicate that the addition of iron, nickel and indium at comparatively low levels has little to no effect on material hardness but does reduce the grain size significantly which improves workability.

In general, the best procedure for making up the alloys of the present invention is first to make a master alloy containing all the constituent metals, except gold. Modification of the master alloy is accomplished to meet specifications and use by adding thereto the correct amount of each constituent, and finally to alloy the master alloy with pure (99.9%) gold.

Master alloy compositions are calculated from gold alloy formulations so that when pure gold is added to master alloy in a ratio to yield a particular karat, the primary and minor components of the master alloy dilute to effective metallurgical concentrations. Master alloy formulations are most useful when they can be used for more than one karat without loss of critical physical properties. For example, A master alloy formulated to contain 0.60% iron could be used to make 10K, 14K and 18K gold alloys since the final concentration of iron in these compositions would be 0.35%, 0.25% and 0.15% respectively.

A typical master alloy composition is as follows:

| Constituent | General Range of Percentages | Preferred Range of Percentages |
|---|---|---|
| Silver | 1.00%-85.00% | 5.00%-65.00% |
| Copper | 1.00%-95.00% | 4.00%-90.00% |
| Zinc | 0.10%-40.00% | 2.00%-30.00% |
| Nickel | 0.00%-10.00% | 0.01%-1.00% |
| Iron | 0.01%-5.00% | 0.05%-1.00% |
| Indium | 0.00%-4.00% | 0.90%-2.00% |
| Silicon | 0.01%-5.00% | 0.01%-4.00% |
| Boron | 0.00%-4.00% | 0.004%-3.00% |
| Phosphorus | 0.00%-1.00% | 0.00%-0.50% |

An example of such a master alloy composition is:

| Silver | Copper | Zinc | Iron | Indium | Silicon | Boron | Nickel |
|---|---|---|---|---|---|---|---|
| 14.30% | 73.677% | 11.100% | 0.200% | 0.300% | 0.300% | 0.004% | 0.120% |

The master alloy is actually a karat gold formulation without the gold. Pure gold, at 99.99%, is added at the time of melting. The master alloy is useful for two main reasons. It allows a manufacturer to inventory a relatively low cost composition which is ready for use with only the addition of gold. A single master alloy formulation can be used to make various karat golds (e.g. 10K, 12K, 14K) by changing the gold to master alloy ratio, it provides greater production flexibility than karat gold grain. Further, master alloy alone can be added to a scrap of one karat to dilute the available gold content to a targeted lower karat.

For example, 14K scrap can be mixed with master alloy to obtain 10K material. Likewise, pure gold can be added to 10K scrap in the appropriate weight to obtain 14K material.

We claim:

1. An alloy used in the manufacture of gold objects consisting of gold in an amount ranging form 25% to 92%, silver in an amount ranging from 1% to 50%, copper in an amount ranging from 1% to 50%, zinc in an amount ranging from 0.1% to 20%, nickel in an amount ranging from 0.0% to 5.0%, iron in an amount ranging from 0.01% to 2.0%, indium in an amount ranging from 0.01% to 2.0%, silicon in an amount ranging from 0.01% to 1.0%, boron in an amount ranging from 0.0% to 1.0%, and phosphorous in an amount ranging from 0.00% to 0.05.

2. An alloy used in the manufacture of gold objects consisting of gold in an amount ranging from 41.67% to 75.00%, silver in an amount ranging from 4.75% to 6.66%, copper is an amount ranging from 30.88% to 43.61%, zinc in an amount ranging from 1.00% to 7.00%, nickel in an amount ranging from 0.05% to 0.20%, iron in an amount around 0.05% to 0.45%, indium in an amount around 0.30% to 0.60%, silicon in an amount ranging from 0.02% to 0.60%, boron in an amount ranging from 0.001% to 0.15%, and phosphorous 0 to 0.20%.

3. A master alloy used to form gold based alloys in the manufacture of gold objects consisting essentially of silver in an amount ranging from 1.00% to 85.00%, copper in an amount ranging from 1.00% to 95.00%, zinc in an amount ranging from 0.10% to 40.00%, nickel in an amount ranging from 0.00% to 10.00%, iron in an amount ranging from 0.00% to 5.00%, indium in an amount ranging from 0.00% to 4.00%, silicon in an amount ranging from 0.01% to 5.00%, boron in an amount ranging from 0.00% to 4.00%, and phosphorous in an amount ranging from 0.00% to 1.00%.

4. A master alloy used to form gold based alloy in the manufacture of gold objects consisting of silver in an amount ranging from 5.00% to 65.00%, copper in an amount ranging from 4.00% to 90.00%, zinc in an amount ranging from 2.00% to 30.00%, nickel in an amount ranging from 0.01% to 1.00%, iron in an amount ranging from 0.05% to 1.00%, indium in an amount ranging from 0.90% to 2.00%, silicon in an amount ranging from 0.01% to 4.00%, boron in an amount ranging from 0.004% to 3.00%, and phosphorous in an amount ranging from 0.00% to 0.50%.

5. A master alloy used to form gold based alloys in the manufacture of gold objects consisting of silver in an amount of 14.30%, copper in an amount of 73.677%, zinc in an amount of 11.100%, iron in an amount of 0.200%, indium in an amount of 0.300%, silicon in an amount of 0.300%, boron in an amount of 0.004%, and nickel in an amount of 0.120%.

6. A clad product comprising a layer of gold alloy on a substrate, the gold alloy consisting of gold in an amount ranging from 25% to 92%, silver in an amount ranging from 1% to 50%, copper in an amount ranging from 1% to 50%, zinc in an amount ranging from 0.1% to 20%, nickel 0.05-5% iron in an amount ranging from 0.01% to 2.0%, indium in an amount ranging from 0.10% to 1.0%, boron in an amount ranging from 0.0% to 1.0%, and phosphorous 0.00% to 0.05%.

7. A clad product comprising a layer of gold alloy on a substrate, the gold alloy consisting of gold in an amount ranging from 41.67% to 58.33%, silver in an amount ranging from 4.75% to 6.66%, copper in an amount ranging from 30.88% to 43.61%, zinc in an amount ranging from 1.0% to 7.01%, nickel in an amount around 0.05%, iron in an amount around 0.15%, indium in an amount around 0.30%, silicon in an amount around 0.50%, and boron in an amount around 0.05%.

* * * * *